US006907976B2

(12) United States Patent
Abe et al.

(10) Patent No.: US 6,907,976 B2
(45) Date of Patent: Jun. 21, 2005

(54) TIME INCREMENT SELECTOR

(75) Inventors: Hiroshi Abe, Iwatsuki (JP); Kazumi Suzuki, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 0 days.

(21) Appl. No.: 10/685,556

(22) Filed: Oct. 14, 2003

(65) Prior Publication Data

US 2004/0129526 A1 Jul. 8, 2004

Related U.S. Application Data

(62) Division of application No. 09/825,697, filed on Apr. 3, 2001, now abandoned, which is a continuation of application No. 09/111,923, filed on Jul. 8, 1998, now abandoned.

(30) Foreign Application Priority Data

Jul. 8, 1997 (JP) ..... 9-216917
Feb. 17, 1998 (JP) ..... 10-74793

(51) Int. Cl.[7] ..... G07D 5/02
(52) U.S. Cl. ..... 194/302
(58) Field of Search ..... 194/302; 221/15, 221/16

(56) References Cited

U.S. PATENT DOCUMENTS 3,796,295 A 3/1974 Montolivo et al.
3,815,717 A 6/1974 Arseneau
3,918,565 A 11/1975 Fougere et al.
4,086,527 A * 4/1978 Cadot ..... 324/233
4,109,775 A 8/1978 Hayashi
4,192,972 A 3/1980 Bertogilo et al.
4,231,105 A 10/1980 Schuller et al.
4,354,613 A 10/1982 Desai et al.
4,498,570 A 2/1985 King et al.
4,499,982 A 2/1985 Sugimoto et al.
4,499,985 A 2/1985 Schuller
4,601,380 A 7/1986 Dean et al.
4,616,323 A 10/1986 Hayashi
4,625,851 A 12/1986 Johnson et al.
4,677,565 A 6/1987 Ogaki et al.
4,706,794 A 11/1987 Awane et al.
4,821,862 A * 4/1989 Nelson ..... 194/241
4,834,231 A 5/1989 Awane et al.
4,895,238 A 1/1990 Speas
4,905,813 A 3/1990 Rademacher
4,967,896 A 11/1990 Hara
5,103,956 A 4/1992 Jang
5,154,272 A 10/1992 Nishiumi et al.
5,236,071 A 8/1993 Lee
5,310,035 A 5/1994 Dobransky et al.
5,316,124 A 5/1994 Barnes et al.
5,377,809 A 1/1995 Iabrrola
5,566,807 A 10/1996 Morun
5,642,119 A * 6/1997 Jacobs ..... 342/69
RE35,649 E 11/1997 Baer
6,390,269 B1 * 5/2002 Billington et al. ..... 194/217

* cited by examiner

*Primary Examiner*—Donald P. Walsh
*Assistant Examiner*—Mark J. Beaucheaine
(74) *Attorney, Agent, or Firm*—Rob L. Phillips; Quirk & Tratos

(57) ABSTRACT

A coin selecting apparatus is set forth which includes detectors adapted to detect a plurality of parameters of diameter, material and thickness of a deposited coin. A processor compares the detected data to stored data for an authentic coin to determine authenticity. The deposited coins are summed and compared to an amount set by a coding switch to be deposited. A display displays the amounts received and authenticated.

1 Claim, 5 Drawing Sheets

TIME INCREMENT SELECTOR

CROSS-REFERENCE TO RELATED APPLICATIONS

This application is a divisional of U.S. application Ser. No. 09/825,697, filed on Apr. 3, 2001 now abandoned, which is a continuation of U.S. application Ser. No. 09/111,923, filed on Jul. 8, 1998, now abandoned.

FIELD OF THE INVENTION

The present invention relates to electron and coin selector apparatus for sorting coins such as currency. More particularly, the present invention relates to a coin selector apparatus suitable for attachment to a toll game machine, automatic vending machine and a service apparatus with a timer.

BACKGROUND

Up until the present, various coin selector apparatus have been developed. For example, an electronic coin selector apparatus is disclosed by the specification of applicant's patent application (unexamined Japanese patent application 8-255480).

A conventional coin selector apparatus is equipped only with functions which sort coins in the proper manner. The coin apparatus provided with other functions has not heretofore been considered. That is, a coin selecting apparatus has not been provided which can set the pre-determined amount of coins or tokens required to operate the machine or device, which displays the amount of deposited money and which, when the user is purchasing time, displays time corresponding to the deposited money.

SUMMARY

It is an objective of the present invention to provide a coin selector apparatus with the ability to set the functions of amounts to be received and to display the amounts received at the selector. In other words, the objective of the present invention offers a coin selecting apparatus which is provided with a function which sets the desired money required to operate the device and which displays the amount of deposited money. Accordingly, the coin selector according to the present invention can confirm the suitableness of the money deposited in the selector.

Accordingly, a selecting apparatus for a machine or device requiring a pre-determined quantity of coins or tokens to operate is set forth which includes a housing and means for receiving the coins into the housing. A detector is disposed in the housing adapted to detect, concerning the coins deposited, at least a plurality of the parameters selected from a group of parameters consisting of material composition, thickness and diameter. The detector is adapted to issue data signals corresponding to each detected parameter. A processor is provided including a data structure having, for each selected parameter, data corresponding to that selected parameter for an authentic coin. The processor receives the data signals from the detector(s) and compares it with the stored data for an authentic coin or token to determine the authenticity of the coin or token. If the coin or token is determined authentic, the processor issues a first data signal and in response to determining if the coin is not authentic issues a second data signal.

Means are provided for selecting the pre-determined quantity necessary to operate the machine or device, the processor adapted to sum the data corresponding to the first signals indicative of receipt of an authentic coin and to compare the summed value to the pre-determined quantity to determine if the amount has been received. In response to receipt of the pre-selected and pre-determined amount, the processor issues an operating signal to operate the machine or device. A display is in communication with the processor and is adapted to display the summed values as authentic coins are received.

According to another embodiment, a time value is assigned to each coin. As the coin is received and tested by the detector and determined to be authentic, a data signal is issued to add the corresponding increment of time, e.g. 13 minutes to the play or the operation of the device and to display the summed increments at the display. Means are provided to select the increment of time which can be assigned for each coin or denomination thereof and to select a pre-determined maximum amount of time which can be accumulated. In the event that the processor detects an authentic coin which would result in an accumulated value or sum of time exceeding the pre-determined maximum time, the coin would be rejected and returned back to the customer.

BRIEF DESCRIPTION OF THE DRAWINGS

These and other features and advantages of the present invention will become better appreciated as the same becomes better understood with reference to the specification, claims and drawings wherein:

DETAILED DESCRIPTION

Figure 1:
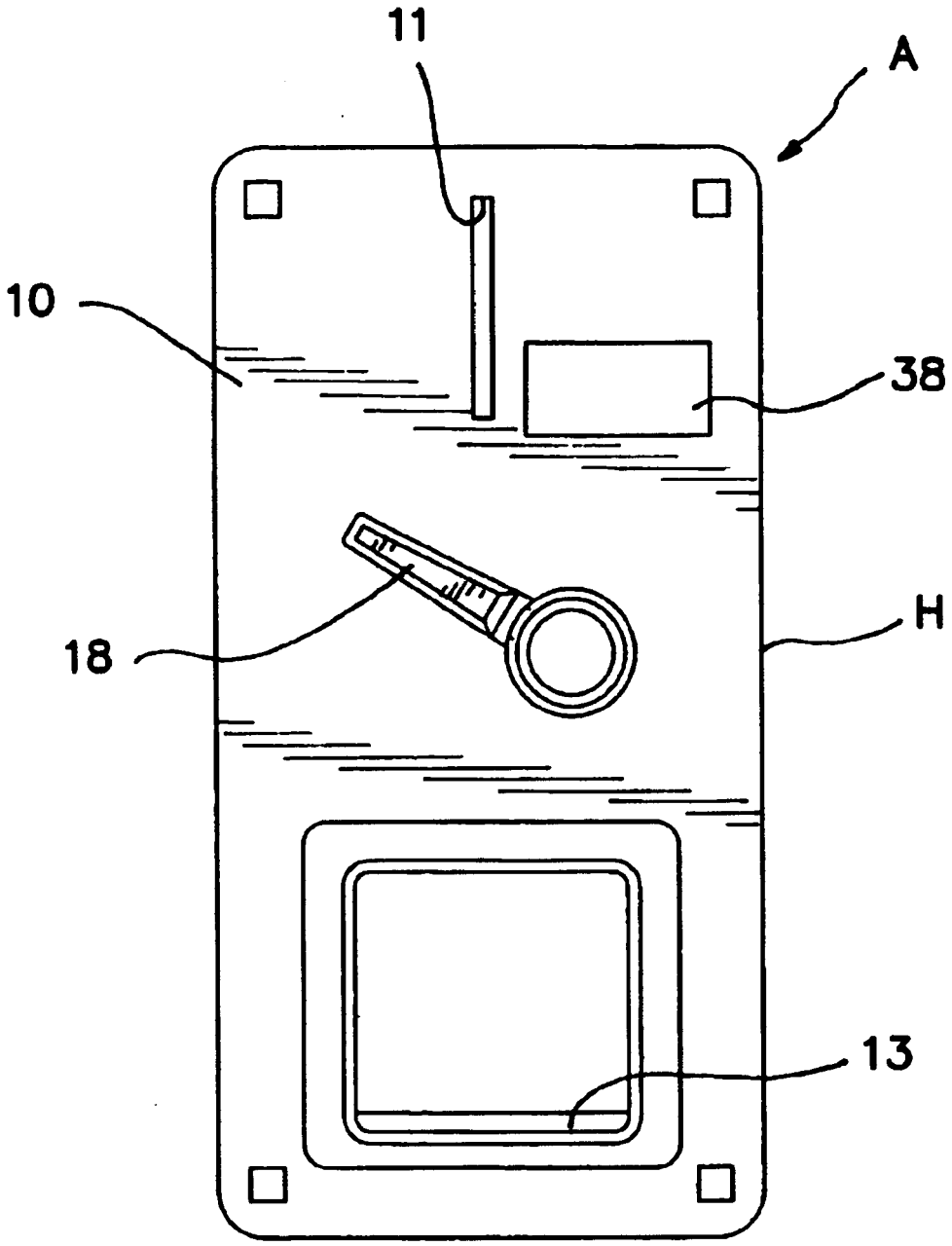
FIG. 1 is a front elevation view of an embodiment of the invention.
Figure 2:
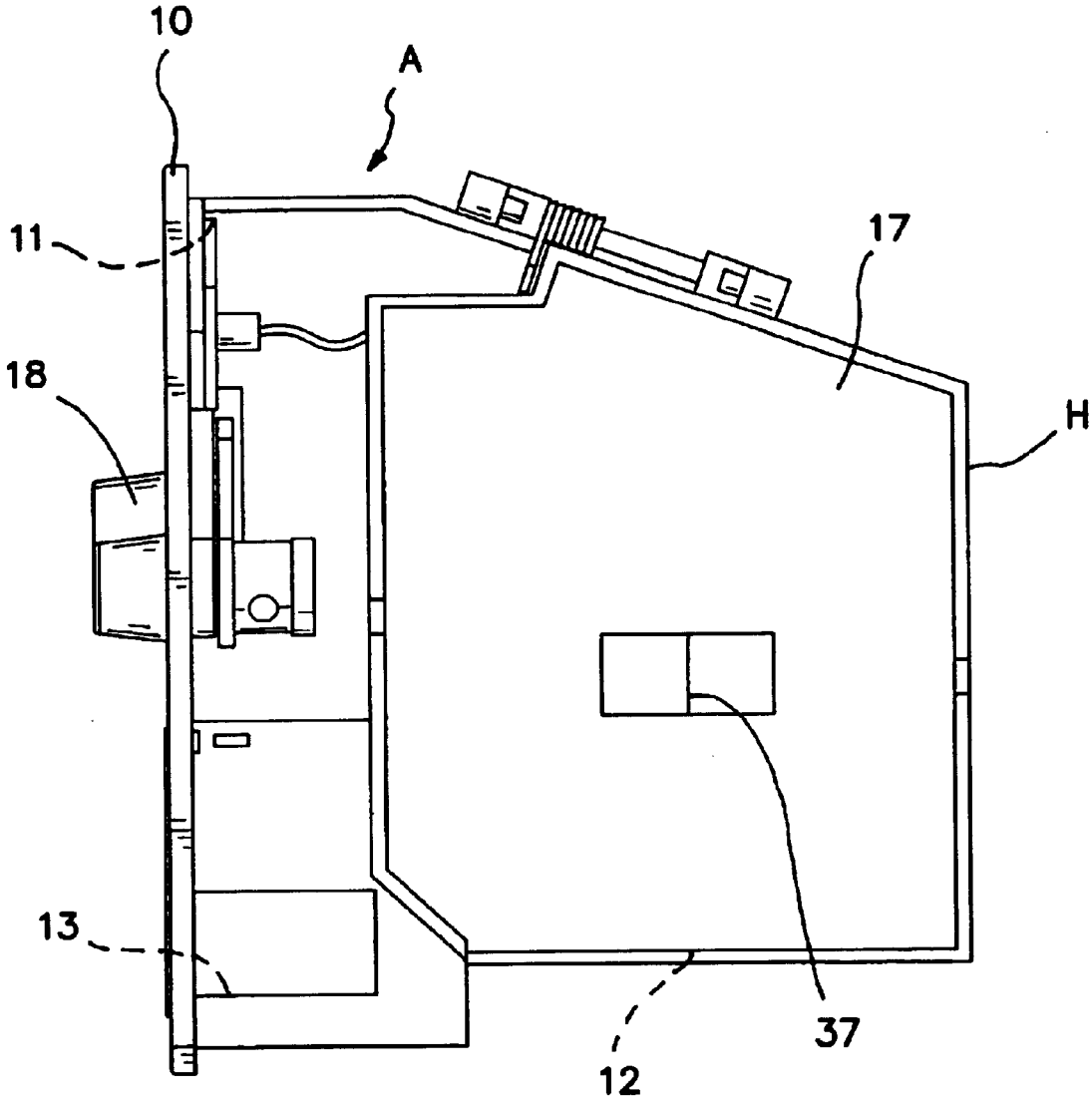
FIG. 2 is a right side view of the apparatus of FIG. 1.

Turning to the drawings, FIGS. 1 and 2 show the coin selector apparatus A. The apparatus A has a front panel 10 with an opening 11 adapted to receive a deposited coin or token. While the following description refers to coins of various denominations, it is to be understood that different coins or tokens could be used. As shown, the front panel 10 may be an elongated rectangle. The front panel 10 forms part of a housing H which is box-like. The bottom of the apparatus A has a passage 12 to pass an authenticated and received coin or token for collection thereof and a return opening 13 through which unauthenticated or rejected coins are rejected from the apparatus A. A lever 18 operates a coin return mechanism of known construction to discharge the retained but rejected coin to the return opening 13. A side panel 17 is removably secured to define a portion of the housing H. A setting mechanism 37 which preferably is a coding switch on the side panel 17 is adapted to set the parameters of the money to be received and authenticated by the apparatus A as hereinafter described. As shown, the setting mechanism is disposed on the side panel 17.

Proximate the deposit opening 11 there is included a display 38. When a coin is deposited in the apparatus A, the coin moves first through the deposit opening 11 and drops along an inside S-shaped path (not shown) formed on the inside of the apparatus A for purposes which will hereinafter become evident.

Figure 3:
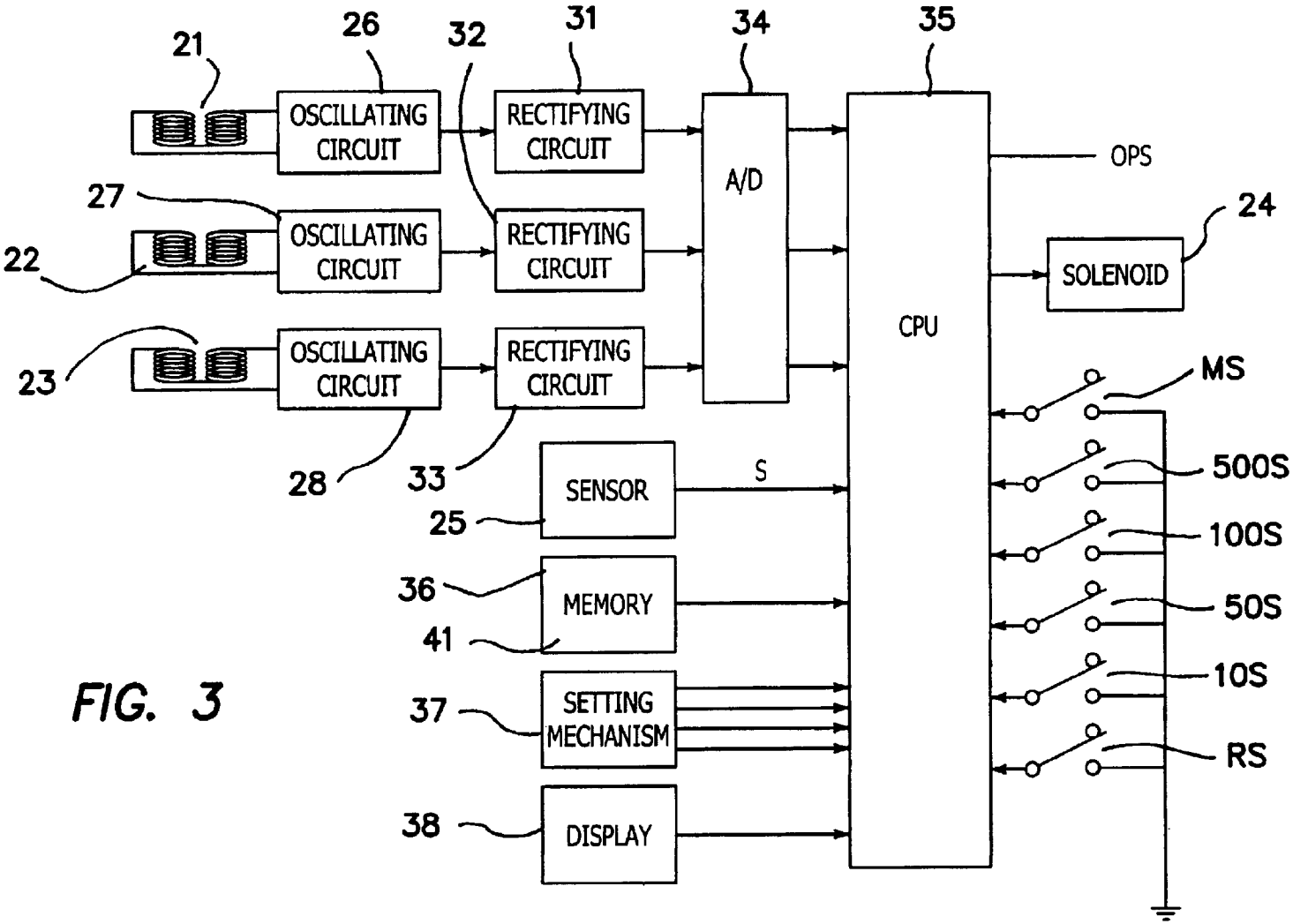
FIG. 3 is a block diagram of the electronic components for the apparatus.

Turning to FIG. 3, the apparatus A includes detecting means preferably embodied by three pairs of first, second and third coils 21–23 disposed in the upper part of the apparatus A. As described below, when a coin is determined to be genuine a solenoid 24 operates to open a gate (not shown) in the path whereby the genuine coin drops through the passage 12 in the bottom of the housing H for collection and storage. The storage is disposed in the gaming machine or device.

Preferably first coils 21 are adapted to detect the material composition of the coin or token and are connected to an oscillating circuit 26 which operates at a comparatively low frequency. Similarly, second coils 22 are adapted to detect the thickness of the coin or token and are connected to an oscillating circuit 27 of comparatively high frequency. Finally, the third coils 23 are adapted to detect the diameter of the coin or token. The third coils 23 are connected to an oscillating circuit 28 of comparatively high frequency. The signals from the first, second and third coils 21–23 are rectified by rectifying circuits 31–33, respectively, containing detection means which issue signals corresponding to the detected parameter, i.e. material, thickness and diameter. These signals from the rectifying circuits 31–33 are issued to a converting circuit 34 which converts the analog signal to a digital signal. The analog signals from the rectifying circuits 31–33, as converted by the converter 34 into digital signals, are input into a processor shown as CPU 35 in FIG. 3. Each digital signal from the rectifying circuits 31–33 as converted by the converter 34 are processed by the CPU 35.

With continuing reference to FIG. 3, a data structure or memory 36 is provided which stores parameter data 41 which corresponds to the parameters of material composition, thickness and diameter for genuine coins. An MS switch is adapted to select the memory mode of the data stored at coin data 41 or the mode of operation which operates the apparatus A. For example, the 500S switch shown in FIG. 3 establishes coin data in the memory 36 for a 500 yen coin, the 100S switch sets up coin data 41 in the memory 36 of data corresponding to an authentic 100 yen coin, the 50S switch sets up coin data 41 in the memory 36 corresponding to an authentic 50 yen coin and switch 10S switch sets up coin data 41 in the memory 36 corresponding to the data for an authentic 10 yen coin.

With continuing reference to FIG. 3, the setting mechanism 37 consists of two coding switches (not shown) the first which sets up pre-determined amounts to be received of 900–0 yen per 100 yen unit coins and a second coding switch which sets up pre-determined amounts of 90–0 yen per 100 yen coin units. Accordingly, by using the setting mechanism 37, the user, if the pre-determined sum is 130 yen, can set the apparatus A to receive 100 yen units and 30 yen units to arrive at the pre-determined amount. A pre-determined amount is sent from the setting mechanism 37 to the processor 35.

The display 38 at the front panel 10 is also shown in FIG. 3 as communicating with the processor 35 to display the deposited and received amounts and times as hereinafter described.

Also shown in FIG. 3 is an RS switch which is reset which when closed, is provided for rewriting the coin data 41 stored in memory 36.

Finally, and with continuing reference to FIG. 3, a sensor 25 is provided proximate the passage 12. When the deposited coin is determined to be authentic, by comparison by processor 35 comparing the coin data 41 stored in the memory 36 with the data received from the first through third coils, the solenoid 24 opens the gate to pass the coin through the passage 12 for collection. The sensor 25 issues a signal S to the CPU 35 which confirms the passage of the coin through the passage 12 is adapted to place the passage 12. If it is determined that the coin is unauthentic, no signal is sent to the solenoid 24 and the gate remains closed preventing the coin from moving through the passage 12. The unauthentic coin may be removed by the lever 18 at the coin return 13.

Figure 4:
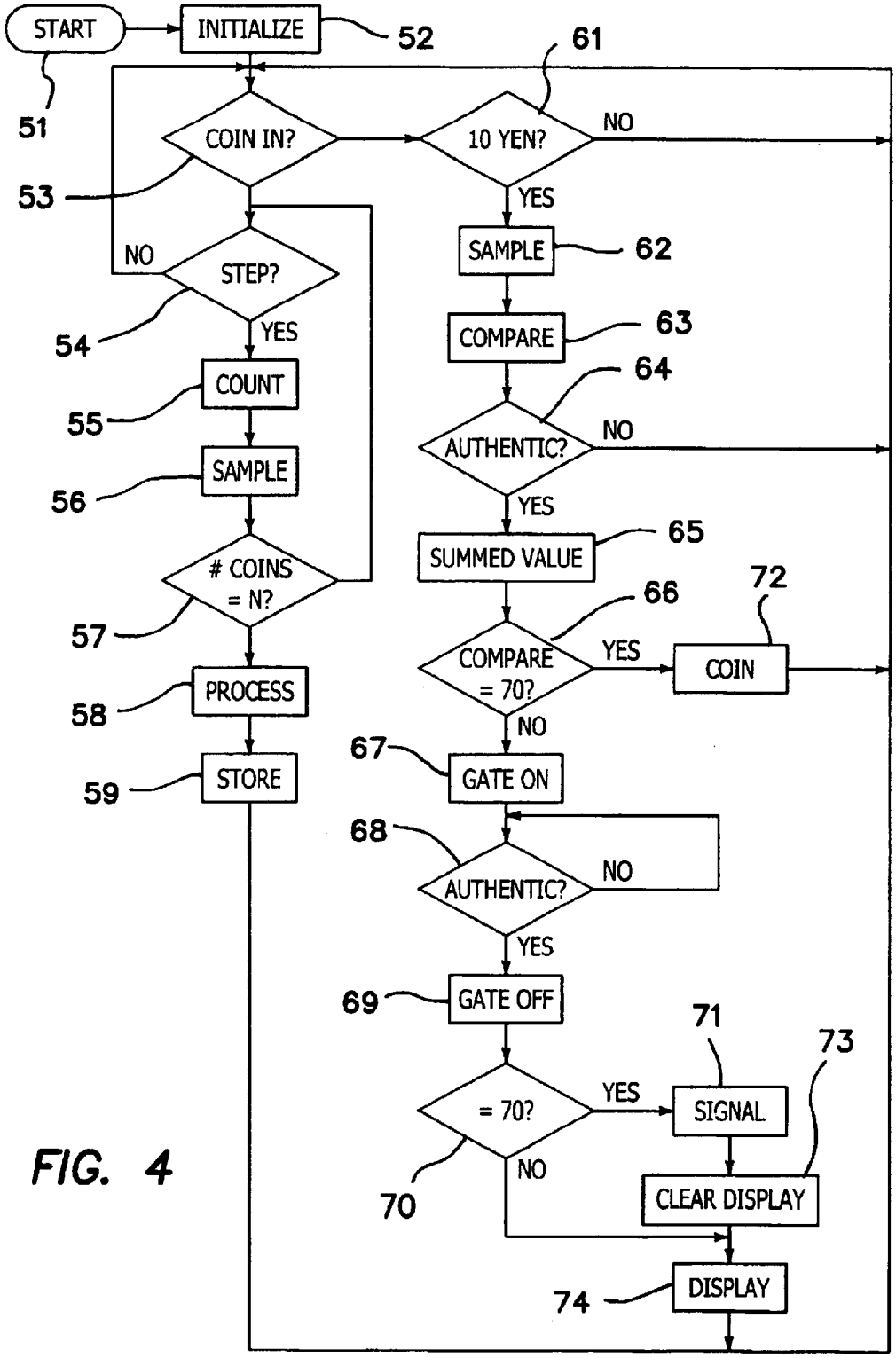
FIG. 4 is a flow chart showing the operation of the apparatus.

Turning to FIG. 4, the flow chart is shown for the operation of the apparatus A. At 51, the apparatus A is started and at 52 initialized. At initialization, the initial settings are installed, solenoid 24 and sensor 25 are tested. At 53 the mode is selected to, for example, receive up to a 50 yen coin. In this case, the MS coding switch (FIG. 3) is preset to introduce the coin data 41 from memory 36 into the CPU 35 corresponding to the data of material, thickness and diameter for an authentic 50 and 10 yen coins. In any event, the apparatus A has been set to accept up to a 50 yen coin.

At step 54, a 50 yen coin is deposited through the deposit opening 11 and the number of 50 yen coins is counted at 55. The data from the first through third coils 21 through 23 for each 50 yen coin is sampled at 56. At 57 the number of coins counted is compared to a pre-determined number N of 50 yen coins (the number N representing the largest number of 50 yen coins that can be accepted to make-up the pre-determined and pre-selected amount necessary to activate the device). The coin data sampled at 56 is processed statistically at 58. This processed data is temporarily stored at 59 as coin data 41 in memory 36.

With continuing reference to FIG. 4, next, at 61, 10 yen coins are inserted into the apparatus and more particularly its deposit opening 11. The coin data is sampled at the first through third coils 21–23 and at 63 this data is compared at the CPU 35 with the coin data stored in memory at 36. At 64 the CPU 35 determines whether the deposited coin sampling data corresponds to authentic coins. If the deposited coins or tokens are determined not to be genuine, they or it is not accepted and can be returned to the customer by using the lever 18. If it is determined that the coins are authentic, the accepted money, e.g. the 50 yen coin and deposited money, e.g. the 10 yen coin, are summed at 65. At 66 the summed value from 65 is compared to determine whether the sum is greater than the preselected setting value of, for example, 70 yen the amount necessary to activate the game or device. If the summed value exceeds the setting value such as by the customer inserting too many 50 yen coins, the second inserted coin is at 72 subtracted from the sum arrived at at step 65 and the coin resulting in the excess is not received and can be returned to the customer. If the sum at 65 does not exceed the setting value, at 67 a signal is sent by the CPU 35 to the solenoid to open the gate to pass the received coin(s) through the passage 12 for collection thereof. At 68 the sensor 25 senses whether the received coin(s) have passed the gate. If the sensor 25 senses the passing of the coin, at 69 the solenoid 24 if tuned off and the gate is closed. At 70 the summed value from 65 is compared to the setting value, e.g. 70 yen. If the summed value equals the setting value, at 71 the OPS signal (FIG. 3) is sent to activate the machine or device. At 73 the displayed, deposited and summed amount is cleared from the display 38. If the summed value from step 65 does not equal the setting value, at 74 the deposited and received amount is displayed at the display 38 and the apparatus A awaits deposit of additional coins.

As can be appreciated if, with continuing reference to item 66 in FIG. 4, if two 50 yen coins were deposited and authenticated, the total amount recognized would exceed the setting value of 70 yen, the second 50 yen coin is not accepted to add to the value sum of the amount deposited and the authenticated second 50 yen coin at 72 is returned. As shown at step 68, if the coin is determined to be unauthentic at 69 the solenoid is turned off closing the gate to prevent the fake or unauthentic coin from being discharged from the passage 12. The unauthentic coin is positioned for return through the return opening 13.

In the present example, a deposited and authenticated 50 yen coin is tested at 70 against the required setting value of 70 yen. Inasmuch as the 50 yen coin does not amount to a sufficient deposit to equal 70 yen, the amount of deposit of 50 yen is displayed at 74 at the display 38.

When a 10 yen coin is deposited and returning to step 65, the apparatus adjudges whether or not the coin is authentic by comparing the data obtained from the first through third coils, oscillating circuits 26 through 28, rectifying circuits 31–33, converter 34 to the CPU 35 compared with the coin data 41 stored in memory 36 to determine whether or not the 10 yen coin deposited is authentic. If it is determined to be unauthentic, it is positioned for return from the return opening 13. If it is determined to be authentic, it is accepted and at 66 is compared with the setting value, e.g. 70 Yen, to determine whether or not this incremental added value by the deposit of the coin exceeds the pre-selected amount. If it does, it is at 72 disposed for return from the return opening 13. If it is not, i.e. the summed value at 65 does not exceed 70 yen, the solenoid at 67 is activated for passage of the authenticated 10 yen coin from the passage 12 for receipt. If the coin is determined to be unauthentic, the solenoid at 69 is turned off and again the coin is positioned for return from the return opening 13. At 70, the value added by the deposit of this second coin is compared to the pre-selected amount. In that the 10 yen coin plus the 50 yen coin do not total the setting value of 70 yen, the sum of 60 yen is displayed at 74 at the display 38.

Further, a second 10 yen coin is deposited. As before, the coin is authenticated, discharged if determined to be unauthentic, compared to the pre-selected amount required to operate the machine to determine whether its incremental added value exceeds the pre-selected amount and reserves that coin if indeed that is the case for return through the return opening 13. If it does not, it is compared at 70 with the pre-selected setting value and inasmuch as, with the second 10 yen coin, the total amount deposited equals 70 yen, at 71, the game or device is activated for player operation at 73 the amount displayed at the display 38 is erased at 73. When the total amount deposited equals the pre-determined amount necessary to operate the machine, the OPS signal (FIG. 3) is sent by the CPU 35 to operate the system.

Accordingly, the apparatus, and with reference to FIG. 3, is adapted in this example to receive either one 50 yen coin and two 10 yen coins or 7 10 yen coins to operate the game or device.

If additional monies are necessary to operate the device, the switches can be closed in the appropriate fashion. For example, if 770 yen were required to operate the device or system, the 500S switch, 100S switch, 50S switch and 10S switch would all be closed to provide the data for the operation of the apparatus A inasmuch as coins of these denominations can be deposited in combination to obtain the pre-selected amount.

Figure 5:
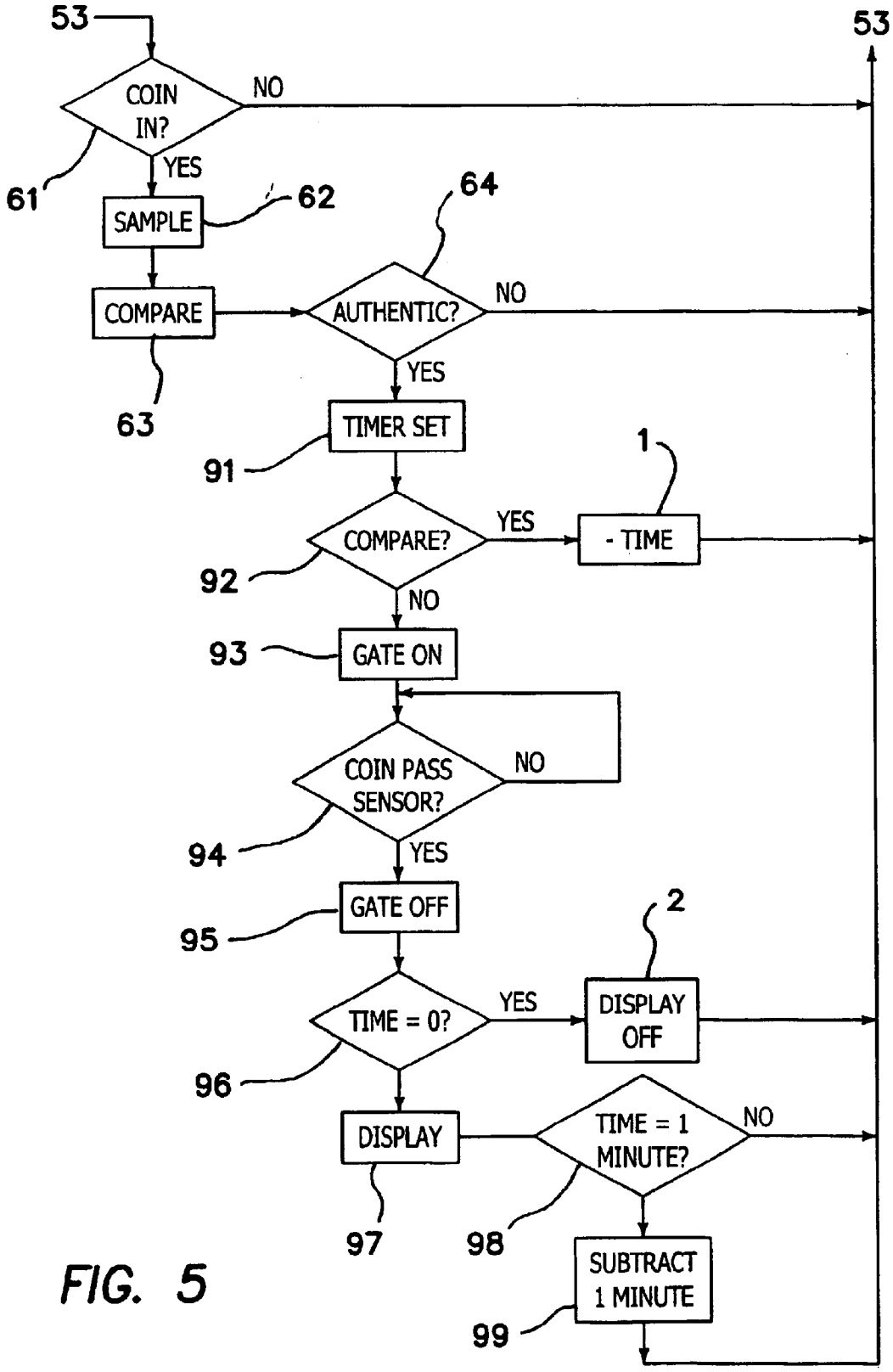
FIG. 5 is a flow chart showing a further operation of the apparatus.

Turning to FIG. 5, a flow chart is shown for another operation of the apparatus A. As to the setting mechanism, the first coding switch of FIG. 4 (10S) is replaced by a switch setting an order of magnitude of one and the second switch, e.g. the 50S switch, is set at an order of magnitude of three. The setting of the switches in this manner results in setting the device or mechanism to co-relate receipt of a 10 yen coin into a device operation time of 13 minutes. When a coin at 61 is deposited the coin parameter data is measured by the first through third coils 21–23 at 62 and at 63 is compared by the CPU 35 with the coin data 41 stored in the memory 36. For example, if a 50 yen coin is deposited the sampled data for the 50 yen coin will be compared at 63 and if at 66 the coin is determined to be authentic, at 91 the timer data is set by multiplying the setting value, e.g. 13 minutes for 10 yen, or 13×50/10. At 92, the amount of time stored as a result of the deposit is compared to a pre-selected amount, for example, 91 minutes, to determine whether or not the timer data added by deposit of the coin exceeds the preselected value. If it does, the added timer data by deposit of this coin is subtracted at 1 and coin is reserved for return to the customer. If it does not, at 93 the CPU 35 sends a signal to the solenoid 24 to open the gate to receive the coin. The sensor 25 signals when the coin has passed the gate and moved through the passage 12. When the received coin has passed the sensor 25 at 95 the CPU 35 controls the solenoid 24 to close the gate. At 96 the timer data is compared to zero. If the timer data is zero, the display 36 at 2 is turned off. If the timer data does not equal zero, the summed value of the timer data is at 97 displayed at the display 38 and the machine or device is activated. At 98 the CPU 35 determines whether one minute of elapsed operation time has passed. If it has, the at 99 one minute is subtracted from the timer data, i.e. deducted from the operation time. In this fashion a device can be operated on a time basis up to a maximum preselected setting time, based upon the coins received. When the timer data reaches zero the machine is de-activated and at 2 the display 38 is turned off.

We claim:

1. A selector apparatus for coin operation of a device for a period of time comprising:

a housing;

means for receiving the coins into the housing;

means for rejecting coins deposited into the apparatus said means for rejecting coins deposited into the apparatus including means for selecting a predetermined maximum time value which can be accumulated, said processor adapted to compare the summed value to said maximum value and if said summed value exceeds said maximum value issuing a signal to reject the coin;

a detector disposed in the housing adapted to detect, concerning each coin, at least a plurality of the parameters selected from a group of parameters of, material composition, thickness and diameter, said detector adapted to issue a data signal corresponding to each detected parameter;

a processor including a data structure including, for each selected parameter, data corresponding to the selected parameter for said coins, said processor adapted to receive said data signals and compare them to the stored data for an authentic coin or token to determine the authenticity of the coin or token, said processor in response to determination of an authentic coin issuing a data signal, said data signal including data corresponding to the denomination of the received coin or token;

means for selecting the increment of time to be added for operation of the device for each coin received, said processor adapted to receive the first signal and sum the time values corresponding to the coins received, said processor in response to receipt of coins issuing an operating signal to operate the machine for the sum of the time values; and a display in communication with the processor adapted to display the accumulated summed values of time as authentic coins.

* * * * *